US005164046A

United States Patent [19]

Ampulski et al.

[11] Patent Number: 5,164,046

[45] Date of Patent: * Nov. 17, 1992

[54] METHOD FOR MAKING SOFT TISSUE PAPER USING POLYSILOXANE COMPOUND

[75] Inventors: Robert S. Ampulski, Fairfield; Wolfgang U. Spendel, Cincinnati, both of Ohio

[73] Assignee: The Procter & Gamble Company, Cincinnati, Ohio

[ * ] Notice: The portion of the term of this patent subsequent to Oct. 22, 2008 has been disclaimed.

[21] Appl. No.: 700,351

[22] Filed: May 7, 1991

Related U.S. Application Data

[63] Continuation of Ser. No. 299,912, Jan. 19, 1989, abandoned.

[51] Int. Cl.[5] ..... D21H 21/14

[52] U.S. Cl. ..... 162/111; 162/112; 162/158; 162/164.4; 162/175; 162/184; 428/153

[58] Field of Search ..... 162/111, 112, 158, 164.4, 162/175, 184; 428/153, 446, 198, 211, 290, 449, 452

[56] References Cited

U.S. PATENT DOCUMENTS

| | | | |
|---|---|---|---|
| 2,826,551 | 3/1958 | Geen | 252/89 |
| 3,301,746 | 4/1964 | Sanford et al. | 162/113 |
| 3,438,807 | 4/1969 | Pikula | 117/154 |
| 3,484,275 | 12/1969 | Lewicki, Jr. | 117/93.4 |
| 3,598,622 | 8/1971 | Maher et al. | 162/175 |
| 3,755,071 | 8/1973 | Bey et al. | 162/184 |
| 3,755,220 | 8/1973 | Freimark et al. | 260/17.3 |
| 3,812,000 | 5/1974 | Salvucci, Jr. et al. | 162/111 |
| 3,814,096 | 6/1974 | Weiss et al. | 128/260 |
| 3,818,533 | 6/1974 | Scheuer | 15/104.93 |
| 3,821,068 | 6/1974 | Shaw | 162/111 |
| 3,844,880 | 10/1974 | Meisel, Jr. et al. | 162/169 |
| 3,964,500 | 6/1976 | Drakoff | 132/7 |
| 3,967,030 | 6/1976 | Johnson et al. | 428/266 |
| 3,974,025 | 8/1976 | Ayers | 162/113 |
| 3,994,771 | 11/1976 | Morgan, Jr. et al. | 162/113 |
| 4,028,172 | 6/1977 | Mazzarella | 162/164 R |
| 4,112,167 | 9/1978 | Dake et al. | 428/154 |
| 4,158,594 | 6/1979 | Becker et al. | 162/112 |
| 4,191,609 | 3/1980 | Trokhan | 162/113 |
| 4,300,981 | 11/1981 | Carstens | 162/109 |
| 4,355,021 | 10/1982 | Mahl et al. | 424/28 |
| 4,376,149 | 3/1983 | Martin | 428/266 |
| 4,395,454 | 7/1983 | Baldwin | 428/290 |
| 4,441,962 | 4/1984 | Osborn, III | 162/111 |
| 4,447,294 | 5/1984 | Osborn | 162/158 |
| 4,469,840 | 9/1984 | Alberts et al. | 524/500 |
| 4,481,243 | 11/1984 | Allen | 428/154 |
| 4,513,051 | 4/1985 | Lavash | 428/212 |
| 4,637,859 | 1/1987 | Trokhan | 162/109 |
| 4,795,530 | 1/1989 | Soerens et al. | 162/11 |
| 4,950,545 | 8/1990 | Walter et al. | 428/446 |

FOREIGN PATENT DOCUMENTS

| | | | |
|---|---|---|---|
| 899223 | 5/1972 | Canada | 154/72 |
| 0144658 | 6/1985 | European Pat. Off. . | |
| 3420940 | 1/1985 | Fed. Rep. of Germany . | |
| WO82/00485 | 2/1982 | PCT Int'l Appl. | 162/111 |
| 849433 | 9/1960 | United Kingdom . | |

OTHER PUBLICATIONS

"Applications of Armak Quaternary Ammonium Salts", Bulletin 76-17, Armak Company (1977).

U.S. Ser. No. 206,621 filed Jun. 14, 1988, Ampulski et al.

U.S. Ser. No. 280,086 filed Dec. 5, 1988, Spendel.

U.S. Ser. No. 280,119 filed Dec. 5, 1988, Spendel.

*Primary Examiner*—Steve Alvo

*Attorney, Agent, or Firm*—Bart S. Hersko; Fredrick H. Braun

[57] ABSTRACT

A process for making soft tissue paper which includes the steps of wet-laying cellulosic fibers to form a web, applying to the wet web, at a fiber consistency level of from about 10% to about 80%, a polysiloxane material, and then drying and creping the web to form the finished tissue paper. The process may further include the steps of applying an effective amount of a surfactant material to enhance softness and/or wettability control; and/or an effective amount of a binder material, such as starch, for linting control, and/or to contribute tensile strength to the tissue paper.

19 Claims, No Drawings

METHOD FOR MAKING SOFT TISSUE PAPER USING POLYSILOXANE COMPOUND

This is a continuation of application Ser. No. 299,912 filed on Jan. 19, 1989, now abandoned.

TECHNICAL FIELD

This invention relates, in general, to a process for preparing tissue paper; and more specifically, to a process for preparing high bulk tissue paper having a soft, silky, flannel-like tactile feel; and enhanced tactile perceivable bulk, and physiological surface smoothness.

BACKGROUND OF THE INVENTION

Soft tissue paper is generally preferred for disposable paper towels, and facial and toilet tissues. However, known methods and means for enhancing softness of tissue paper generally adversely affect tensile strength. Tissue paper product design is, therefore, generally, an exercise in balancing softness against tensile strength.

Both mechanical and chemical means have been introduced in the pursuit of making soft tissue paper: tissue paper which is perceived by users, through their tactile sense, to be soft. Such tactile perceivable softness may be characterized by, but not limited to, resilience, flexibility, and smoothness; and subjective descriptors such as feeling like silk or flannel. The present invention pertains to a process for improving the tactile perceivable softness of tissue paper—in particular high bulk, creped tissue paper—through the incorporation of chemical additives: in particular, polysiloxane materials which impart a silky or flannel-like feel to the tissue paper without rendering it greasy or oily to the tactile sense of users of products comprising such tissue paper. Additionally, surfactant material may be added to further enhance softness and/or surface smoothness and/or to at least partially offset any reduction in wettability caused by the polysiloxane; and binder material such as starch may be added to at least partially offset reductions in strength and or increasing in linting propensity that results from the polysiloxane and, if used, the surfactant additive.

Representative high bulk, creped tissue papers which are quite soft by contemporary standards, and which are susceptible to softness enhancement through the present invention are disclosed in the following U.S. Pat. Nos.: 3,301,746 which issued Jan. 31, 1967 to Lawrence H. Sanford and James B. Sisson; 3,974,025 which issued Aug. 10, 1976 to Peter G. Ayers; 3,994,771 which issued Nov. 30, 1976 to George Morgan, Jr. and Thomas F. Rich; 4,191,609 which issued Mar. 4, 1980 to Paul D. Trokhan; and 4,637,859 which issued Jan. 20, 1987 to Paul D. Trokhan. Each of these papers is characterized by a pattern of dense areas: areas more dense than their respective remainders, such dense areas resulting from being compacted during papermaking as by the crossover knuckles of imprinting carrier fabrics. Other high bulk, soft tissue papers are disclosed in U.S. Pat. Nos. 4,300,981 which issued Nov. 17, 1981 to Jerry E. Carstens; and 4,440,597 which issued Apr. 3, 1984 to Edward R. Wells and Thomas A. Hensler. Additionally, achieving high bulk tissue paper through the avoidance of overall compaction prior to final drying is disclosed in U.S. Pat. No. 3,821,068 which issued Jun. 28, 1974 to D. L. Shaw; and avoidance of overall compaction in combination with the use of debonders and elastomeric bonders in the papermaking furnish is disclosed in U.S. Pat. No. 3,812,000 which issued May 21, 1974 to J. L. Salvucci, Jr.

Chemical debonders such as those contemplated by Salvucci, referred to above, and their operative theory are disclosed in such representative U.S. Pat. Nos. as 3,755,220 which issued Aug. 28, 1973 to Friemark et al; 3,844,880 which issued Oct. 29, 1974 to Meisel et al; and 4,158,594 which issued Jan. 19, 1979 to Becker et al. Other chemical treatments which have been proposed to improve tissue paper include, for example, that disclosed in German Patent 3,420,940, Kenji Hara et al, to wit: to impregnate toilet tissue paper with a combination of a vegetable, animal, or synthetic hydrocarbon oil, and a silicone oil such as dimethylsilicone oil to make it easier to clean and wipe with.

Additionally, a well known mechanical method of increasing tensile strength of paper made from cellulosic pulp is by mechanically refining the pulp prior to papermaking. In general, greater refining results in greater tensile strength. However, consistent with the foregoing discussion of tissue tensile strength and softness, increased mechanical refining of cellulosic pulp negatively impacts tissue paper softness, all other aspects of the papermaking furnish and process being unchanged. However, through the use of the present invention, tensile strength can be increased without negatively impacting softness; or, alternatively, softness can be improved without negatively impacting tensile strength.

It is an object of this invention to provide a process for preparing tissue paper which has an enhanced tactile sense of softness.

It is another object of this invention to provide a process for preparing tissue paper which has a silky, flannel-like feel.

It is a further object of this invention to provide a process for preparing tissue paper which has increased tactile softness at a particular level of tensile strength relative to tissue paper which has been softened by conventional techniques.

These and other objects are obtained using the present invention, as will be seen from the following disclosure.

SUMMARY OF THE INVENTION

The present invention encompasses a process for making soft tissue paper. This process includes the steps of wet laying cellulosic fibers to form a web, applying to the web, at a fiber consistency of from about 10% to about 80% (total web weight basis), a sufficient amount of a polysiloxane such that between about 0.004% and about 0.75% of said polysiloxane, dry fiber weight basis, is retained by the tissue paper, and then drying and creping the web. Preferably, the amount of polysiloxane retained by the tissue paper is between 0.004% to about 0.3%, based on the dry fiber weight of the tissue paper. The resulting tissue paper preferably has a basis weight of from about 10 to about 65 g/m$^2$ and a fiber density of less than about 0.6 g/cc.

The polysiloxane is applied subsequent to formation of the wet web and prior to drying to completion. Surprisingly, it has been found that significant tissue softening benefits can be achieved by much lower levels of polysiloxanes when the polysiloxane is applied to a wet web, as compared to a dry web (e.g., during the converting operation). In fact, an important feature of the process disclosed herein, is that the silicone level is low enough to be economical. Also, tissue paper treated with low levels of polysiloxane retain a high level of wettability, an important feature for a tissue product.

Preferred polysiloxanes for use in the process of the present invention include an amino-functional polydimethylpolysiloxane wherein less than about 10 mole percent of the side chains on the polymer contain an amino-functional group. Because molecular weights of polysiloxanes are difficult to ascertain, the viscosity of a polysiloxane is used herein as an objectively ascertainable indicia of molecular weight. Accordingly, for example, about 2% substitution has been found to be very effective for polysiloxanes having a viscosity of about one-hundred-twenty-five (125) centistokes; and viscosities of about five-million (5,000,000) centistokes or more are effective with or without substitution. In addition to such substitution with amino-functional groups, effective substitution may be made with carboxyl, hydroxyl, ether, polyether, aldehyde, ketone, amide, ester, and thiol groups. Of these effective substituent groups, the family of groups comprising amino, carboxyl, and hydroxyl groups are more preferred than the others; and amino-functional groups are most preferred.

Exemplary commercially available polysiloxanes include DOW 8075 and DOW 200 which are available from Dow Corning; and Silwet 720 and Ucarsil EPS which are available from Union Carbide.

The process for preparing tissue paper treated with a polysiloxane in accordance with the present invention may further comprise the step of adding an effective amount of a surfactant to enhance the tactile perceivable surface smoothness of the tissue paper and/or to at least partially offset any reduction of wettability of the tissue paper which would otherwise result from the incorporation of the polysiloxane. The effective amount of surfactant is such that, preferably, from about 0.01 to about 2 percent on a dry fiber weight of the tissue paper; and, more preferably, from about 0.05 to about 1.0 percent is retained by the tissue paper. Also, preferably, the surfactant is noncationic; and is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher.

Also, the process for preparing tissue paper in accordance with the present invention may further comprise the step of adding an effective amount of a binder material such as starch to at least partially offset any reduction of tensile strength and/or increase in linting propensity which would otherwise result from the incorporation of the polysiloxane and, if present, surfactant material. The effective amount of binder material is such that, preferably, from about 0.01 to about 2 percent on a dry fiber weight basis of the tissue paper, is retained by the tissue paper.

All percentages, ratios and proportions herein are by weight, unless otherwise specified.

The present invention is described in more detail below.

DETAILED DESCRIPTION OF THE INVENTION

Briefly, the present invention provides tissue paper having a silky, flannel-like feel, and enhanced tactile perceivable softness through the addition of a polysiloxane additive to a wet tissue web. Such process may also include the addition of an effective amount of surfactant material and/or a binder material such as starch to the wet web. Generally speaking, surfactant may be included to enhance tactile perceivable, physiological surface smoothness and/or to assure sufficient wettability for the intended purposes of the tissue paper (e.g., as toilet tissue); and a binder material such as starch may be included to at least partially offset any reduction of tissue paper tensile strength and/or exacerbation of linting propensity which would otherwise be precipitated by the addition of the polysiloxane and, if used, the surfactant. Surprisingly, it has been found that very low levels of polysiloxane provide a significant tissue softening effect when applied to wet tissue webs in accordance with the present invention as compared to application of polysiloxanes to dry tissue webs (e.g., in the converting operations). To ensure high retention rates, the wet web is formed and dewatered prior to application of the polysiloxane additive in order to reduce the loss of the polysiloxane due to drainage of free water. Importantly, it has been found that the levels of polysiloxane used to soften the tissue paper are low enough that the tissue paper retains high wettability.

The present invention is applicable to tissue paper in general, including but not limited to conventionally felt-pressed tissue paper; pattern densified tissue paper such as exemplified by Sanford-Sisson and its progeny; and high bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between 10 $g/m^2$ and about 65 $g/m^2$, and density of about 0.60 g/cc or less. Preferably, basis weight will be below about 35 $g/m^2$ or less; and density will be about 0.30 g/cc or less. Most preferably, density will be between 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and dried at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further drying by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted since the web is subjected to substantial mechanical compressional forces while the fibers are moist and are then dried while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayres on Aug. 10, 1976, and U.S. Pat. No. 4,191,609, issued to Paul D. Trokhan on Mar. 4, 1980; all of which are incorporated herein by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. Formation of the densified zones may be accomplished by application of fluid pressure, such as with a vacuum type device or a blow-through dryer, or by mechanically pressing the web against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the tissue paper surface comprises densified knuckles having a relative density of at least 120% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Patent No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized.

In addition to papermaking fibers, the papermaking furnish used to make tissue paper structures may have other components or materials added thereto as may be or later become known in the art. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. Nos. 3,700,623, issued on Oct. 24, 1972 and 3,772,076, issued on Nov. 13, 1973, both issued to Keim and both being hereby incorporated by reference. One commercial source of a useful polyamide-epichlorohydrin resins is Hercules, Inc. of Wilmington, Del. which markets such resin under the mark Kymeme TM 557H.

Polyacrylamide resins have also been found to be of utility as wet strength resins. These resins are described in U.S. Pat. Nos. 3,556,932, issued on Jan. 19, 1971 to Coscia, et al. and 3,556,933, issued on Jan. 19, 1971 to Williams et al., both patents being incorporated herein by reference. One commercial source of polyacrylamide resins is American Cyanamid Co. of Stanford, Conn. which markets one such resin under the mark Parez TM 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. It is to be understood that the addition of chemical compounds such as the wet strength resins discussed above to the pulp furnish is optional and is not necessary for the practice of the present development.

Types of polysiloxane materials which are suitable for use in the present invention include polymeric, oligomeric, copolymeric, and other multiple-monomeric siloxane materials. As used herein, the term polysiloxane shall include all of such polymeric, oligomeric, copolymeric and other multiple-monomeric siloxane materials. Additionally, the polysiloxane can be either a straight chain, a branched chain or have a cyclic structure.

Preferred polysiloxane materials include those having monomeric siloxane units of the following structure:

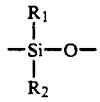

(1)

wherein, $R_1$ and $R_2$ for each siloxane monomeric unit can independently be any alkyl, aryl, alkenyl, alkaryl, aralkyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the radicals can be either a straight chain, a branched chain, or have a cyclic structure. The radicals $R_1$ and $R_2$ can, additionally and independently, be other silicone functionalities such as, but not limited to siloxanes, polysiloxanes, and polysilanes. The radicals $R_1$ and $R_2$ can also contain any of a variety of organic functionalities including, for example, alcohol, carboxylic acid, and amine functionalities.

The degree of substitution and the type of substituent have been found to affect the relative degree of soft, silky feeling and hydrophilicity imparted to the tissue paper structure. In general, the degree of soft, silky feeling imparted by the polysiloxane increases as the hydrophilicity of the substituted polysiloxane decreases. Aminofunctional polysiloxanes are especially preferred in the present invention.

Preferred polysiloxanes include straight chain organopolysiloxane materials of the following general formula:

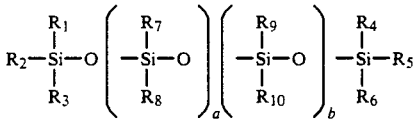

(2)

wherein each $R_1$–$R_9$ radical can independently be any $C_1$–$C_{10}$ unsubstituted alkyl or aryl radical, and $R_{10}$ is any substituted $C_1$–$C_{10}$ alkyl or aryl radical. Preferably each $R_1$–$R_9$ radical is independently any $C_1$–$C_4$ unsubstituted alkyl group. Those skilled in the art will recognize that technically there is no difference whether, for example, $R_9$ or $R_{10}$ is the substituted radical. Preferably the mole ratio of b to (a+b) is between 0 and about 20%, more preferably between 0 and about 10%, and most preferably between about 1% and about 5%.

In one particularly preferred embodiment, $R_1$–$R_9$ are methyl groups and $R_{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxanes include, for example, polydimethylsiloxane, polydimethylsiloxane having an alkyl hydrocarbon $R_{10}$ radical and polydimethylsiloxane having one or more amino, carboxyl, hydroxyl, ether, polyether, aldehyde, ketone, amide, ester, thiol and/or other $R_{10}$ functionalities including alkyl and alkenyl analogues of such functionalities. For example, an amino functional alkyl group as $R_{10}$ could be an amino-functional or an aminoalkylfunctional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane is flowable or can be made to be flowable for application to the tissue paper. This includes, but is not limited to, viscosity as low as about 25 centistokes to about 20,000,000 centistokes or even higher. High viscosity polysiloxanes which themselves are resistant to flowing can be effectively deposited upon the tissue paper webs by such methods as, for example, emulsifying the polysiloxane in surfactant or providing the polysiloxane in solution with the aid of a solvent, such as hexane, listed for exemplary purposes only. Particular methods for applying polysiloxanes to tissue paper webs are discussed in more detail below.

Parenthetically, while not wishing to be bound by a theory of operation, it is believed that the tactile-benefit efficacy of the polysiloxane is directly related to its average molecular weight; and that viscosity is directly related to molecular weight. Accordingly, due to the relative difficulty of directly determining molecular weights of polysiloxanes as compared to determining their viscosities, viscosity is used herein as the apparent operative parameter with respect to imparting enhanced tactile response to tissue paper: i.e., softness, silkiness, and flannel-like.

References disclosing polysiloxanes include U.S. Pat. No. 2,826,551, issued Mar. 11, 1958 to Geen; U.S. Pat. No. 3,964,500, issued Jun. 22, 1976 to Drakoff; U.S. Pat. No. 4,364,837, issued Dec. 21, 1982 to Pader; and British Patent 849,433, published Sep. 28, 1960 to Woolston. Also, *Silicon Compounds.* pp. 181-217, distributed by Petrarch Systems, Inc., 1984, contains an extensive listing and description of polysiloxanes in general.

The polysiloxane is applied subsequent to formation of the wet web and prior to drying to completion. It has been found that addition of the polysiloxane to the wet end of the paper machine (i.e., the paper furnish) is impractical due to low retention levels of the polysiloxane. Therefore, in a typical process, the web is formed and then dewatered prior to application of the polysiloxane in order to reduce the loss of polysiloxane due to drainage of free water. The polysiloxane is preferably applied to the wet web at a fiber consistency level of between 10% and about 80% (based on the weight of the wet web), more preferably at a fiber consistency level between about 15% and about 35%, in the manufacture of conventionally pressed tissue paper; and to a wet web having a fiber consistency of between about 20% and about 35% in the manufacture of tissue paper in papermaking machines wherein the newly formed web is transferred from a fine mesh Fourdrinier to a relatively coarse imprinting/carrier fabric. This is because it is preferable to make such transfers at sufficiently low fiber consistencies that the fibers have substantial mobility during the transfer; and it is preferred to apply the polysiloxane after their mobility has substantially dissipated as water removal progresses through the papermaking machine. Also, addition of the polysiloxane at higher fiber consistencies assures greater retention in and on the paper: i.e., less polysiloxane is lost in the water being drained from the web to increase its fiber consistency. Surprisingly, retention rates in excess of about 90% are expected at the preferred fiber consistencies without the utilization of chemical retention aids.

The polysiloxane is preferably applied to the wet web in an aqueous solution, emulsion, or suspension. The polysiloxane can also be applied in a solution containing a suitable, nonaqueous solvent, in which the polysiloxane dissolves or with which the polysiloxane is miscible: for example, hexane. The polysiloxane may be supplied in neat form or, preferably, emulsified with a suitable surfactant emulsifier. Emulsified polysiloxane is preferable for ease of application since a neat polysiloxane aqueous solution must be agitated to inhibit separation into water and polysiloxane phases.

The polysiloxane should be applied uniformly to the wet tissue paper web so that substantially the entire sheet benefits from the tactile effect of the polysiloxane. Applying the polysiloxane to the wet tissue paper web in continuous and patterned distributions are both within the scope of the invention and meet the above criteria.

Methods of uniformly applying the polysiloxane to the web include spraying and gravure printing. Spraying has been found to be economical, and susceptible to accurate control over quantity and distribution of the polysiloxane, so is most preferred. Preferably, an aqueous mixture containing an emulsified polysiloxane is sprayed onto the wet tissue web as it courses through the papermaking machine: for example, and not by way of limitation, referring to a papermaking machine of the general configuration disclosed in Sanford-Sisson (referenced hereinbefore), either before the predryer, or after the predryer, depending on the desired fiber consistency level. A less preferred method includes deposition of the polysiloxane onto a forming wire or fabric which is then contacted by the tissue web. Equipment suitable for spraying polysiloxane containing liquids onto wet webs include external mix, air atomizing nozzles, such as the 2 mm nozzle available from V.I.B. Systems, Inc., Tucker, Ga. Equipment suitable for printing polysiloxane containing liquids onto wet webs includes rotogravure printers.

It has been found, surprisingly, that low levels of polysiloxane applied to wet tissue paper webs can provide a softened, silky, flannel-like, nongreasy tactile sense of feel to the tissue paper without the aid of additional materials such as oils or lotions. Importantly, these benefits can be obtained for many of the embodiments of the present invention in combination with high wettability within the ranges desirable for toilet paper application. Preferably, tissue paper treated with polysiloxane in accordance with the present invention comprises about 0.75% or less polysiloxane. It is an unexpected benefit of this invention that tissue paper treated with about 0.75% or less polysiloxane can have imparted thereto substantial softness and silkiness benefits by such a low level of polysiloxane. In general, tissue paper having less than about 0.3% polysiloxane, preferably less than about 0.2%, can provide substantial increases in softness and silkiness and flannel-like quality yet remain sufficiently wettable for use as toilet paper without requiring the addition of surfactant to offset any negative impact on wettability which results from the polysiloxane.

The minimum level of polysiloxane to be retained by the tissue paper is at least an effective level for imparting a tactile difference in softness or silkiness or flannel-like quality to the paper. The minimum effective level may vary depending upon the particular type of sheet, the method of application, the particular type of polysiloxane, and whether the polysiloxane is supplemented by starch, surfactant, or other additives or treatments. Without limiting the range of applicable polysiloxane retention by the tissue paper, preferably at least about 0.004%, more preferably at least about 0.01%, and most preferably at least about 0.02% polysiloxane is retained by the tissue paper.

Preferably, a sufficient amount of polysiloxane to impart a tactile sense of softness is disposed in both surfaces of the tissue paper: i.e., disposed on the outwardly facing surfaces of the surface-level fibers. When polysiloxane is applied to one surface of the tissue paper, some of it will, generally, at least partially penetrate to the tissue paper interior. In a preferred embodiment, sufficient polysiloxane to effect a tactile response penetrates through the entire thickness of the tissue paper such that both surfaces have imparted thereto the benefits of polysiloxane. One method found to be useful for facilitating polysiloxane penetration to the opposing surface when the polysiloxane is applied to one surface of a wet tissue paper web is to vacuum dewater the tissue paper from the other surface of the wet tissue paper at the point of application of the polysiloxane.

In addition to treating tissue paper with polysiloxane as described above, it has been found desirable to also treat such tissue paper with surfactant material. This is in addition to any surfactant material that may be present as an emulsifying agent for the polysiloxane.

Tissue paper having in excess of about 0.3% polysiloxane is preferably treated with surfactant when contemplated for uses wherein high wettability is desired. Most preferably, a noncationic surfactant is applied to the wet tissue paper web, in order to obtain an additional softness benefit, on a constant tensile basis, as previously discussed. The amount of surfactant required to increase hydrophilicity to a desired level will depend upon the type and level of polysiloxane and the type of surfactant. However, as a general guideline, between about 0.01% and about 2% surfactant retained by the tissue paper, preferably between about 0.05% and about 1.0%, is believed to be sufficient to provide sufficiently high wettability for most applications, including toilet paper, for polysiloxane levels of about 0.75% or less.

Surfactants which are preferred for use in the present invention are noncationic; and, more preferably, are nonionic. However, cationic surfactants may be used. Noncationic surfactants include anionic, nonionic, amphoteric, and zwitterionic surfactants. Preferably, as stated hereinbefore, the surfactant is substantially nonmigratory in situ after the tissue paper has been manufactured in order to substantially obviate post-manufacturing changes in the tissue paper's properties which might otherwise result from the inclusion of surfactant. This may be achieved, for instance, through the use of surfactants having melt temperatures greater than the temperatures commonly encountered during storage, shipping, merchandising, and use of tissue paper product embodiments of the invention: for example, melt temperatures of about 50° C. or higher. Also, the surfactant is preferably water-soluble when applied to the wet web.

The level of noncationic surfactant applied to wet tissue paper webs to provide the aforementioned softness/tensile benefit ranges from the minimum effective level needed for imparting such benefit, on a constant tensile basis for the end product, to about two (2) percent: preferably between about 0.01% and about 1% noncationic surfactant retained by the web; more preferably, between about 0.05% and about 1.0%; and, most preferably, between about 0.05% and about 0.3%.

The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta TM SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse TM 200 ML available from Glyco Chemicals, Inc. (Greenwich, Conn.). Alkylpolyglycosides are particularly preferred for use in the present invention. The above listings of exemplary surfactants are intended to be merely exemplary in nature, and are not meant to limit the scope of the invention.

The surfactant, in addition to any emulsifying surfactant that may be present on the polysiloxane, may be applied by the same methods and apparatuses used to apply polysiloxanes. These methods include spraying and gravure printing. Preferably, an aqueous mixture containing the surfactant is sprayed on to the wet tissue web as it courses through the paper making machine. Other methods include application to a forming wire or fabric prior to contact with the web. Any surfactant other than polysiloxane emulsifying surfactant material, is hereinafter referred to as "surfactant," and any surfactant present as the emulsifying component of emulsified polysiloxane is hereinafter referred to as "emulsifying agent".

The surfactant, may be applied to the tissue paper simultaneously with, after, or before the polysiloxane. In a typical process, the surfactant is applied subsequent to formation of the wet web and prior to final drying. Preferably, surfactants are applied to the wet tissue webs at fiber consistency levels of between about 10% and about 80%; and, more preferably, between about 15% and about 35%. Surprisingly, retention rates of noncationic surfactant applied to wet webs are high even though the surfactant is applied under conditions wherein it is not ionically substantive to the fibers. Retention rates in excess of about 90% are expected at the preferred fiber consistencies without the utilization of chemical retention aids.

As stated hereinbefore, it is also desirable to treat polysiloxane containing tissue paper with a relatively low level of a binder for lint control and/or to increase tensile strength. As used herein the term "binder" refers to the various wet and dry strength additives known in the art. The binder may be applied to the tissue paper simultaneously with, after or before the polysiloxane and the surfactant, if used. Preferably, binders are added to the wet tissue webs at fiber consistency levels of between about 10% and about 80%, and, more preferably, between about 15% and about 35%.

Starch has been found to be the preferred binder for use in the present invention. Preferably, the tissue paper is treated with an aqueous solution of starch and, as mentioned above, the sheet is moist at the time of application. In addition to reducing linting of the finished tissue paper product, low levels of starch also imparts a modest improvement in the tensile strength of tissue paper without imparting boardiness (i.e., stiffness) which would result from additions of high levels of starch. Also, this provides tissue paper having improved strength/softness relationship compared to tissue paper which has been strengthened by traditional methods of increasing tensile strength: for example, sheets having increased tensile strength due to increased refining of the pulp; or through the addition of other dry strength additives. This result is especially surprising since starch has traditionally been used to build strength at the expense of softness in applications wherein softness is not an important characteristic: for example, paperboard. Additionally, parenthetically, starch has been used as a filler for printing and writing paper to improve surface printability.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca—The Starch From Waxy Corn", H. H. Schopmeyer, Food Industries, December 1945, pp. 106–108 (Vol. pp. 1476–1478).

The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked." The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes.

Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials have heretofore been used primarily as a pulp furnish additive to increase wet and/or dry strength. However when applied in accordance with this invention by application to a wet tissue paper web they may have reduced effect on wet strength relative to wet-end addition of the same modified starch materials. Considering that such modified starch materials are more expensive than unmodified starches, the latter have generally been preferred.

The starch should be applied to the tissue paper while the paper is in a moist condition. The starch based material is added to the wet tissue paper web, preferably when the web has a fiber consistency of about 80% or less. Non-cationic starch materials are sufficiently retained in the web to provide an observable effect on softness at a particular strength level relative to increased refining; and, are preferably applied to wet tissue webs having fiber consistencies between about 10% and about 80%, more preferably, between about 15% and 35%.

Starch is preferably applied to tissue paper webs in an aqueous solution. Methods of application include, the same previously described with reference to application of polysiloxane: preferably by spraying; and, less preferably, by printing. The starch may be applied to the tissue paper web simultaneously with, prior to, or subsequent to the addition of polysiloxane and/or surfactant.

At least an effective amount of a binder, preferably starch, to provide lint control and concomitant strength increase upon drying relative to a non-binder treated but otherwise identical sheet is preferably applied to the sheet. Preferably, between about 0.01% and about 2.0% of a binder is retained in the dried sheet, calculated on a dry fiber weight basis; and, more preferably, between about 0.1% and about 1.0% of a binder material, preferably starch-based, is retained.

Analysis of the amounts of treatment chemicals herein retained on tissue paper webs can be performed by any method accepted in the applicable art. For example, the level of polysiloxane retained by the tissue paper can be determined by solvent extraction of the polysiloxane with an organic solvent followed by atomic absorption spectroscopy to determine the level of silicon in the extract; the level of nonionic surfactants, such as alkylglycosides, can be determined by extraction in an organic solvent followed by gas chromatography to determine the level of surfactant in the extract; the level of anionic surfactants, such as linear alkyl sulfonates, can be determined by water extraction followed by colorimetry analysis of the extract; the level of starch can be determined by amylase digestion of the starch to glucose followed by colorimetry analysis to determine glucose level. These methods are exemplary, and are not meant to exclude other methods which may be useful for determining levels of particular components retained by the tissue paper.

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time." In order to provide a consistent and repeatable test for wetting time, the following procedure may be used for wetting time determinations: first, a dry (greater than 90% fiber consistency level) sample unit sheet, approximately $4\frac{3}{8}$inch$\times 4\frac{3}{4}$ inch (about 11.1 cm $\times$12 cm) of tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 72° F. (about 22° C.), and a timer is simultaneously started; fourth, the timer is stopped and read when wetting of the balled sheet is completed. Complete wetting is observed visually.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably. wetting time is 10 seconds or less.

Hydrophilicity characters of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the above stated wetting times are preferably measured at the end of such two week period. Accordingly, wetting times measured at the end of a two week aging period at room temperature are referred to as "two week wetting times."

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 g/in$^2$ (15.5 g/cm$^2$).

EXAMPLE I

The purpose of this example is to illustrate one method that can be used to make soft tissue paper sheets treated with a polysiloxane in accordance with the present invention.

A pilot scale Fourdrinier papermaking machine is used in the practice of the present invention. The paper machine has a layered headbox having a top chamber, a center chamber, and a bottom chamber. Where applicable as indicated in the following examples, the procedure described below also applies to such later examples. Briefly, a first fibrous slurry comprised primarily of short papermaking fibers is pumped through the top and bottom headbox chambers and, simultaneously, a second fibrous slurry comprised primarily of long papermaking fibers is pumped through the center headbox chamber and delivered in superposed relation onto the Fourdrinier wire to form thereon a three-layer embryonic web. The first slurry has a fiber consistency of about 0.11% and its fibrous content is Eucalyptus Hardwood Kraft. The second slurry has a fiber consistency of about 0.15% and its fibrous content is Northern Softwood Kraft. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The embryonic wet web is transferred from the Foudrinier wire, at a fiber consistency of about 22% at the point of transfer, to a carrier fabric having a 5-shed satin weave, 35 machine-direction and 33 cross-machine-direction monofilaments per inch, respectively. The non-fabric side of the web is sprayed with an aqueous solution containing an emulsified polysiloxane composition, further described below, by a 2 mm spray nozzle located directly opposite a vacuum dewatering box. The wet web has a fiber consistency of about 22% (total web weight basis) when sprayed by the aqueous solution. The sprayed web is carried on the carrier fabric past the vacuum dewatering box, through blow-through predryers after which the web is transferred onto a Yankee dryer. The other process and machine conditions are listed below. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray applied by applicators; the fiber consistency is increased to an estimated 99% before dry creping the web with a doctor blade. The doctor blade has a bevel angle of about 24 degrees and is positioned with respect to the Yankee dryer to provide an impact angle of about 83 degrees; the Yankee dryer is operated at about 350° F. (177° C.); the Yankee dryer is operated at about 800 fpm (feet per minute) (about 244 meters per minute). The dry creped web is then passed between two calender rolls. The two calender rolls are biased together at roll weight and operated at surface speeds of 660 fpm (about 201 meters per minute).

The aqueous solution sprayed through the spray nozzle onto the wet web contains 0.71% by weight of Dow Corning Q2-7224 (a 35% nonionic emulsion of an amino-functional polydimethylpolysiloxane marketed by Dow Corning Corp.). The volumetric flow rate of the aqueous solution through the nozzle is about 3 gal./hr.-cross -direction ft (about 37 liters/hr-meter). The retention rate of the polysiloxane applied to the web, in general, is about 90%.

The resulting tissue paper has a basis weight of 30 g/m$^2$, a density of 0.10 g/cc, and contains 0.025% by weight, of the amino-functional polydimethylpolysiloxane compound.

Importantly, the resulting tissue paper has a silky, flannel-like feel, and enhanced tactile softness.

EXAMPLE II

The purpose of this example is to illustrate one method that can be used to make soft tissue paper sheets wherein the tissue paper is treated with polysiloxane, surfactant and starch.

A 3-layer paper sheet is produced in accordance with the hereinbefore described process of Example I. The tissue web is, in addition to being treated with a polysiloxane compound as described above, also treated with Crodesta TM SL-40 (an alkyl glycoside polyester nonionic surfactant marketed by Croda Inc.) and with a fully cooked amioca starch prepared as described in the specification. The surfactant and starch are applied simultaneously with the emulsified polysiloxane composition as part of the aqueous solution sprayed through the papermachine spray nozzle. Concentration of the Crodesta TM SL-40 nonionic surfactant in the aqueous solution is adjusted so that the level of surfactant retained is about 0.15%, based upon the weight of the dry fibers. Similarly, concentration of the starch in the aqueous solution is adjusted so that the level of amioca starch retained is about 0.2%, based upon the weight of the dry fibers.

The resulting tissue paper has a basis weight of 30g/m$^2$, a density of 0.10 g/cc, and contains 0.025% by weight of the Dow Q2-7224 polydimethypolysiloxane, 0.15% by weight of Crodesta TM SL-40 nonionic surfactant and 0.2% by weight of the cooked amioca starch. Importantly, the resulting tissue paper has a silky flannel-like feel, enhanced tactile softness and has higher wettability and lower propensity for lint than tissue paper treated only with the polysiloxane composition.

What is claimed is:

1. A process for making soft tissue paper, said process comprising the steps of:

a) wet-laying cellulosic fibers to form a web;

b) applying in an aqueous carrier to said web, at a fiber consistency of from about 10% to about 80%, total web weight basis, a sufficient amount of a polysiloxane compound such that from about 0.004% to about 0.75% of said polysiloxane, based on the dry fiber weight of said tissue paper is retained by said web; and c) drying and creping said web; wherein said tissue paper has a basis weight of from about 10 to about 65 gm$^2$ and a density of less than about 0.60 g/cc, wherein said polysiloxane is uniformly disposed on the outwardly facing surfaces of said tissue paper, and wherein said tissue paper after aging two weeks after its manufacture has a wetting time of 2 minutes or less for the tissue paper to be completely wetted with water.

2. The process of claim 1, wherein from about 0.004% to about 0.3% of said polysiloxane is retained by said web, and wherein said tissue paper after aging two weeks after its manufacture has a wetting time of 30 seconds or less.

3. The process of claim 1 wherein said polysiloxane is polydimethylpolysiloxane having a hydrogen bonding functional group selected from the groups consisting of amino, carboxyl, hydroxyl, ether, polyether, aldehyde, ketone, amide, ester, and thiol groups, said hydrogen bonding functional group being present in a molar percentage of substitution of about 20% or less.

4. The process of claim 3 wherein said polysiloxane has a molar percentage of substitution of about 10% or less, and a viscosity of about 25 centistokes or more.

5. The process of claim 3 wherein said polysiloxane has a molar percentage of substitution of from about 1.0% to about 5%, and a viscosity of from about 25 centistokes to about 20,000,000 centistokes.

6. The process of claim 3 wherein said molar percentage of substitution is about 2%, and said viscosity is about 125 centistokes.

7. The process of claim 3 wherein said hydrogen bonding functional group is an amino functional group.

8. The process of claim 1, wherein said polysiloxane is applied to said web when said web has a fiber consistency of from about 15% to about 35%.

9. The process of claim 1, further comprising the step of applying to said web, at a fiber consistency of from about 10% to about 80%, total web weight basis, a sufficient amount of a water soluble surfactant such that from about 0.01% to about 2.0% of said surfactant, based on the dry fiber weight of said tissue paper, is retained by said web.

10. The process of claim 9 wherein said quantity of said surfactant is from about 0.05% to about 1.0% based on the dry fiber weight of said tissue paper.

11. The process of claim 9 wherein said surfactant is noncationic.

12. The process of claim 11 wherein said noncationic surfactant is a nonionic surfactant.

13. The process of claim 9 wherein said surfactant has a melting point of at least about 50° C.

14. The process of claim 1, further comprising the step of applying to said web, at a fiber consistency of from about 10% to about 80%, total web weight basis, a sufficient amount of a binder such that from about 0.01% to about 2.0% of said binder, based on the dry fiber weight of said tissue paper, is retained by said web.

15. The process of claim 14 wherein said binder is starch.

16. The process of claim 15 wherein from about 0.1% to about 1.0% of said starch, based on the dry fiber weight of said tissue paper, is retained by said web.

17. The process of claim 15 wherein said starch is amioca starch.

18. The process of claim 9, further comprising the step of applying to said web, at a fiber consistency of from about 10% to about 80%, total web weight basis, a sufficient amount of a binder such that from about 0.01% to about 2.0% of said binder, based on the dry fiber weight of said tissue paper, is retained by said web.

19. The process of claim 18 wherein said surfactant is noncationic and wherein said binder is starch.

* * * * *

UNITED STATES PATENT AND TRADEMARK OFFICE

CERTIFICATE OF CORRECTION

PATENT NO. : 5,164,046

DATED : November 17, 1992

INVENTOR(S) : Robert S. Ampulski et al.

It is certified that error appears in the above-identified patent and that said Letters Patent is hereby corrected as shown below:

Column 13, line 27, after "nitrogen" insert "-".

Column 13, line 32, after "However"' insert --,--.

Column 13, line 34, after "web" insert --, --.

Column 13, line 52, after "include" delete --,--.

Column 14, line 45, replace the "." after"preferably" with a--,--.

Signed and Sealed this

Twentieth Day of June, 1995

*Attest:*

Bruce Lehman

BRUCE LEHMAN

*Attesting Officer*

*Commissioner of Patents and Trademarks*